US005104182A

United States Patent [19]

Rasnick et al.

[11] Patent Number: 5,104,182

[45] Date of Patent: Apr. 14, 1992

[54] CONVERTIBLE SOFA

[75] Inventors: Glen L. Rasnick, Morristown; James C. Mitchell, Talbott, both of Tenn.

[73] Assignee: The Berkline Corporation, Morristown, Tenn.

[21] Appl. No.: 745,060

[22] Filed: Aug. 12, 1991

[51] Int. Cl.[5] ..... A47C 13/00

[52] U.S. Cl. ..... 297/113; 297/117; 297/194; 297/417

[58] Field of Search ..... 297/113, 112, 117, 191, 297/194, 411, 417

[56] References Cited

U.S. PATENT DOCUMENTS

| | | | |
|---|---|---|---|
| 2,240,748 | 5/1941 | Bak | 297/113 X |
| 2,714,419 | 8/1955 | Killington | 297/113 |
| 4,558,901 | 12/1985 | Yokoyama | 297/113 |
| 4,601,515 | 7/1986 | Hatsutter et al. | 297/117 X |

FOREIGN PATENT DOCUMENTS

| | | | |
|---|---|---|---|
| 284491 | 2/1928 | United Kingdom | 297/113 |
| 327905 | 4/1930 | United Kingdom | 297/113 |

*Primary Examiner*—Laurie K. Cranmer
*Attorney, Agent, or Firm*—David D. Kaufman

[57] ABSTRACT

A backrest section of a unitary sofa, or of a unit of a modular sofa arrangement, is movable between its upright position and an operative position where it overlies the seat to provide a table and/or armrest accessible to sofa occupants on either side thereof. A linkage mechanism comprising a pair of links is mounted to either side of the movable backrest section and includes an opposed recess and detent which snap engage for frictionally retaining the table in the open, substantially horizontal position. The links are pivotally connected to anchor plates fixedly secured to vertical support mebers mounted in the sofa frame.

7 Claims, 2 Drawing Sheets

CONVERTIBLE SOFA

BACKGROUND OF THE INVENTION

This invention relates generally to upholstered furniture and sofas and, more particularly, to a sofa having means for converting a portion thereof into a table and/or armrest.

A problem that occurs with great frequency relates to the need for a table or other convenient surface upon which to rest a drink or food or to use as a writing surface. Tables positioned beside or in front of a chair or sofa are not always convenient and sometimes occupy space which may be limited. Folding tables and the like which may be stored when not in use are at best a bothersome and not wholly satisfactory solution.

A similar problem relates to the lack of a support upon which to rest one's arm or elbow. For example, while the occupant of the end seat of a sofa can rest his outboard arm on the sofa's side arm, there is no support available for the occupant's inboard arm.

For reasons of both comfort and convenience, it would be desirable to have a conventional form of seating furniture, like a sofa, which can be readily converted by an occupant thereof to produce a table or an armrest or both. It is also desirable that the means for such conversion be substantially invisible when inoperative so that the sofa appearance, comfort and design considerations are not adversely affected.

SUMMARY OF THE INVENTION

The present invention provides a sofa or the like having a multiple seating capacity. The sofa has the appearance of an ordinary piece of upholstered furniture, having padded seat cushions and backrest, with no unusual hinges or other attachments being visible. A middle or interior section of the backrest is pivotally movable outwardly and downwardly to produce a table or armrest which is thereupon convenient for use by sofa occupants sitting on either side thereof.

Briefly, the invention comprises a section of the sofa backrest having an inner back planar surface made of a suitable table-top material such as various woods, Formica, or the like. A novel linkage mechanism connects the movable backrest section to the sofa frame so that the table surface is totally concealed when the section is in the closed or upright position. When a table or armrest is desired, the said backrest section is pivoted outwardly whereupon the linkage mechanism effects rotation of the backrest section until the table is in the horizontal orientation. The linkage mechanism includes members which automatically snap engage for frictionally retaining the table in the fully opened operational condition. The linkage mechanism has a minimum number of parts and is substantially concealed and hardly detectable even when the table is in the open operational position. The linkage mechanism is also resistant to damage which could be caused by the application of excessive force to the open table. A simple reverse pressure sufficient to overcome the frictional engagement of the snap engaging members is applied to return the movable sofa section to the upright inoperative position. The table backrest section also includes an upholstered panel adjacent the bottom thereof. The upholstered panel overlies a portion of the table panel when an armrest is desired, or the same may be pivoted upwardly and rearwardly to expose the full and larger table surface.

Numerous other advantages and features of the present invention will become apparent from the following detailed description of the invention, from the claims and from the accompanying drawings.

BRIEF DESCRIPTION OF THE DRAWINGS

In the accompanying drawings forming a part of the specification, and in which like numerals are employed to designate like parts throughout.

DETAILED DESCRIPTION OF THE INVENTION

Figures 1, 2, 3, 3A, 4:
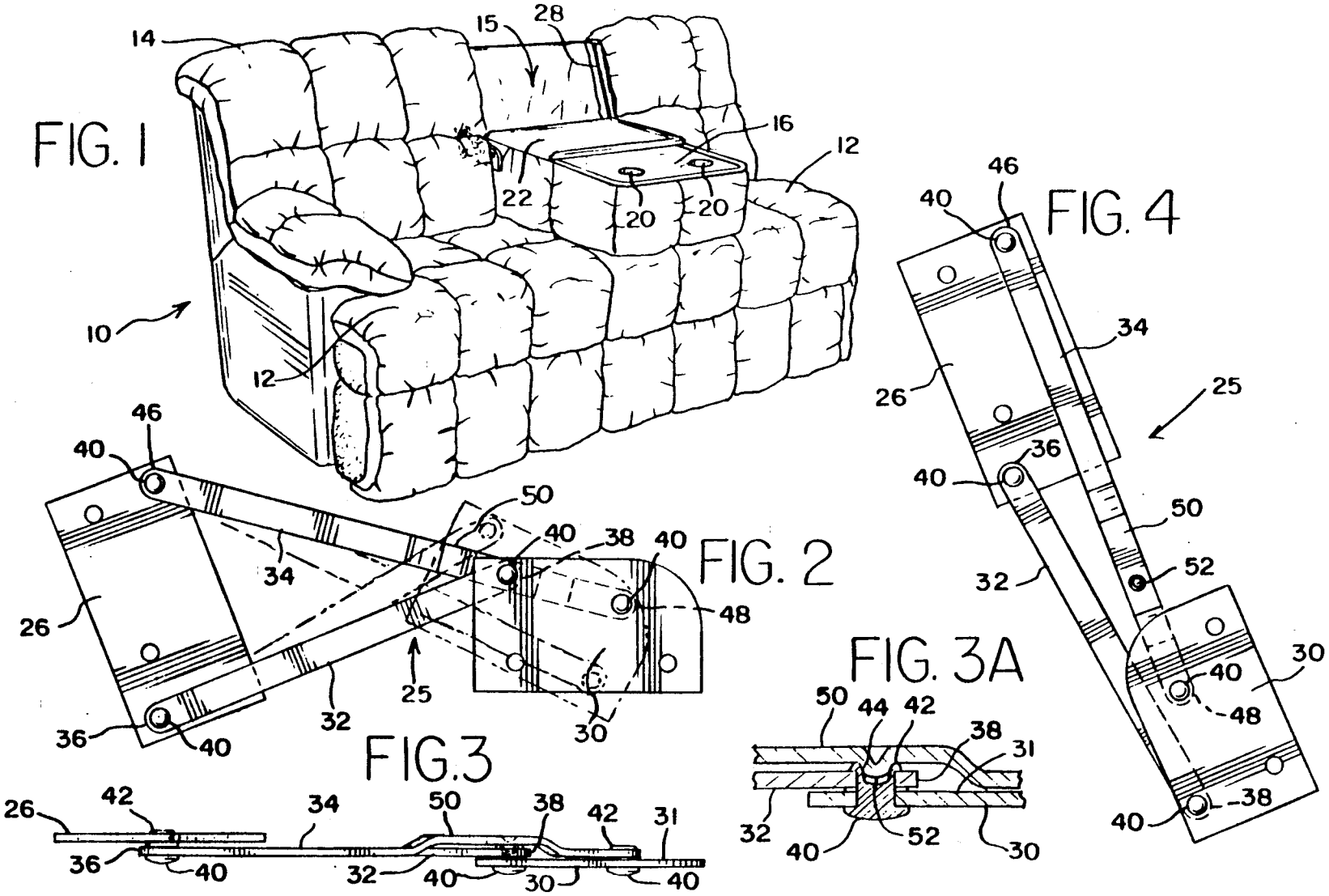
FIG. 1 is a fragmentary perspective view of a portion of a sofa showing a movable backrest section embodying the principles of the invention in the open, operative position.
FIG. 2 is an elevational view of the linkage mechanism of the invention showing the same in the open position.
FIG. 3 is a top plan view of the mechanism of FIG. 2.
FIG. 3A is an enlarged sectional view of a section of FIG. 3 showing a structural detail.
FIG. 4 is an elevational view similar to FIG. 2, but showing the linkage mechanism in the upright, inoperative position.

Referring in greater detail to the drawings, the reference numeral 10 indicates generally a conventional appearing upholstered sofa having a plurality of seat cushions 12 and a backrest 14. The backrest 14 comprises a movable section 15 which convertible into a table and armrest as seen in FIG. 1, but is not otherwise discernible when in the inoperative position of FIG. 5.

Figure 6:
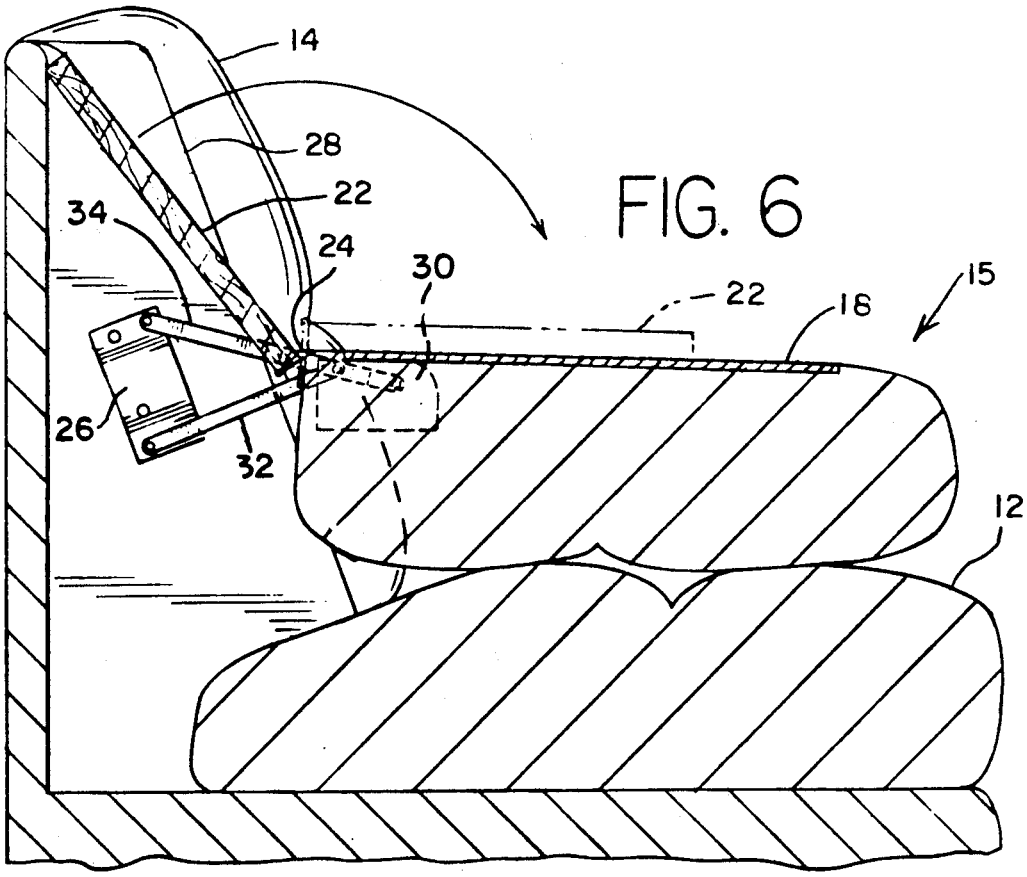
FIG. 6 is a similar view showing the movable section in the open, operative position.

Movable section 15 comprises a back or inner rigid planar panel 16 which extends over substantially the full width and height of said section. When the movable section 15 is moved to the open or operative position, the panel provides a substantially horizontal table surface 18 positioned between a pair of seat cushions 12 as seen in FIGS. 1 and 6. As illustrated, the table surface 18 may include wells 20, 20, for retaining drinking glasses or cups.

An upholstered armrest panel 22 is hingedly connected to the movable section as at 24 and overlies a portion of the table surface 18 thereby serving as an armrest for the convenience of occupants sitting on either side thereof. When a larger table surface 18 is desired, the armrest panel may be simply pivoted upwardly and rearwardly to expose the full area of the table surface.

Figure 5:
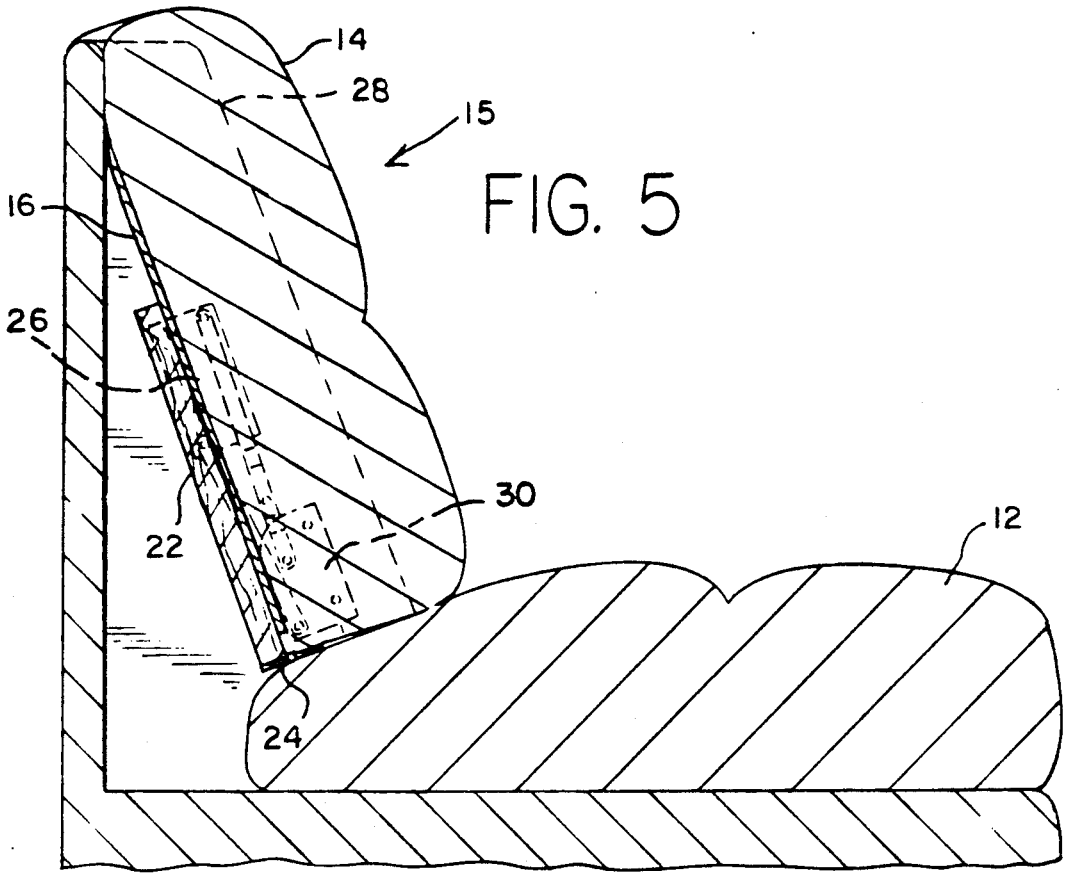
FIG. 5 is an enlarged vertical sectional view of the sofa and movable section showing the section in the upright, inoperative position.

Mounting of the movable backrest section 15 and movement thereof between the concealed, inoperative position of FIG. 5 and the open, operative position of FIGS. 1 and 6 is effected by a linkage mechanism indicated generally by the numeral 25. The linkage mechanism 25 is illustrated in detail in FIGS. 2 through 4 and is present on each lateral side of the movable section 15. Thus, while only the left side of the mechanism will be described in detail, it will be understood that the invention comprises a mirror image structure on the opposite or right side of the movable section 15.

Linkage mechanism 25 comprises an anchor plate 26 which is fixedly mounted on a vertical post or slat 28 affixed to the sofa frame. A motion plate 30 is associated with the anchor plate 26 and said motion plate comprises the lateral support for the movable backrest section 15. The plates 26 and 30 are operationally interconnected by first and second straight-line links 32 and 34.

The first link 32 is pivotally connected at one end 36 to the anchor plate 26 adjacent a corner of said plate, as by a rivet 40. The opposite end 38 of the first link is pivotally connected to the motion plate 30 adjacent a corner of that plate by a similar rivet 40. It will be noted that the rivets 40 are conventionally formed with an annular holding point 42 and a recess 44 in the bottom of the shank thereof (see FIG. 3A) and that the end 38 of the link 32 is mounted to the outboard face 31 of the motion plate 30 for reasons which will become apparent as the description proceeds.

The second link 34 is pivotally connected at one end 46 to the anchor plate 26 by a rivet 40, said end 46 being positioned vertically above the end 36 of the first link 32. The opposite end 48 of the second link 34 is pivotally connected by a rivet 40 to the outboard face 31 of the motion plate 30. It is important to note that the second link 34 comprises a recessed segment 50 which is spaced outwardly away from the outboard face 31 of the motion plate 30, and that said recessed segment is provided with an inwardly projecting detent 52 (see FIGS. 3 and 3A).

To operate the movable section 15 and linkage 25 from the closed position of FIGS. 4 and 5 to the open position of FIGS. 1, 2 and 6, the upper edge of the movable section is pulled outwardly and downwardly. During such motion, the motion plate 30 rotates clockwise as illustrated and the relative positions of the ends 38 and 48 of the first and second links are concomitantly caused to change. As such rotation continues, the detent 52 comes into alignment with the rivet 40 at the end 38 of the first link 32 and snaps into the recess 44 of said rivet. The movable section 15 is thereby locked into the open position of FIGS. 1 and 6 with the table surface 18 and armrest 22 being substantially horizontal. To return the movable section 15 to the closed position, it is simply required to apply sufficient force to overcome the snap fit of the detent 52 and the rivet recess 44 and rotate the section upwardly and rearwardly, or counterclockwise as illustrated.

The frictional engagement of the detent 52 and rivet recess 44, as well as the abutment of the movable backrest section 15 against the seat cushion 12, together provide adequate resistance, under normal conditions of use, to retain the table and/or armrest in the operative horizontal position of FIGS. 1 and 6. However, if excessive or extraordinary force is applied to the table 18 (such as, for example, by a person sitting on the table) the linkage mechanism 25 functions to prevent damage to the linkage and the supporting sofa structure. It will thus be noted that in the event of the application of such excessive force, the detent and rivet will disengage and the motion plate will continue to rotate clockwise (see phantom line showing in FIG. 2), such rotation being made possible by the lateral spacing and non-impeding planes of the first link 32 and the offset section 50 of the second link 34. Accordingly, damage to the linkage mechanism and tearing of the anchor plate 26 from the associated support post 28 is prevented.

While a preferred embodiment of the invention has been illustrated and described as comprising a movable section of a sofa, the invention is intended to apply as well to modular furniture. For example, the movable section 15 could as well comprise the backrest of an armless section of a modular arrangement positionable wherever desired or between adjacent modular sections. It should also be understood that the language employed herein is for the purpose of description rather than limitation, and various changes and variations may be made by those skilled in the art without departing from the spirit and scope of the invention as defined in the appended claims.

What is claimed is:

1. An upholstered sofa comprising:

a plurality of seating spaces;

a backrest behind said seating spaces having a section thereof movable between an upright position and an open position forwardly and away from the backrest;

a rigid panel on a surface of said movable section, said rigid panel being concealed when the movable section is in said upright position;

a linkage mechanism mounting said movable section in the backrest and operational to pivot said movable section to the open position whereby the rigid panel provides a substantially horizontal table surface between a pair of said seating spaces, said linkage mechanism comprising an anchor plate fixedly secured to a vertical support member in said backrest, a motion plate pivotally associated with said anchor plate and supporting said movable section thereon, and first and second links pivotally connected at their opposite ends to said anchor plate and motion plate; and snap-engaging means on said links cooperable for frictionally retaining the movable section in the open position.

2. A sofa according to claim 1 wherein said snap-engaging means comprises a rivet pivotally connecting said first link to said motion plate and having a recess in an end thereof, and a detent on said second link facing said recess whereby said detent snaps into said recess when the movable section is pivoted to the open position.

3. A sofa according to claim 2 comprising an offset segment on said second link, said detent being formed on said offset segment, whereby the snap-engaging means disengages and the movable section pivots beyond the open position responsive to the application of sufficient force to the table.

4. A sofa according to claim 1 comprising an armrest panel pivotally connected to the inner surface of said movable section and concealed when the movable section is in the upright position, said armrest panel overlying a portion of said table surface to provide an armrest and being pivotable rearwardly to expose the entire table surface.

5. In a sofa having a supporting frame, multiple seats, a backrest and a section of the backrest rotatable between an upright inoperative position and an operative position wherein the section overlies one of the seats to provide a table and armrest, a linkage mechanism comprising:

a pair of motion plates, one at either side of said section and movable therewith;

a pair of opposed anchor plates fixedly mounted to said frame, one in association with each of said motion plates;

a pair of links pivotally interconnecting each of said anchor plates to the associated motion plate and operational to enable rotation of said section between the operative and inoperative positions, said pair of links each comprising a first link having one end pivotally connected to the anchor plate and the opposite end pivotally connected to an outboard face of the associated motion plate, and a second link having one end pivotally connected to the anchor plate and the opposite end pivotally connected to the outboard face of the associated motion plate, and means on said first and second links cooperable for frictionally engaging and retaining the movable section in the operative position and for enabling disengagement and further rotation beyond the operative position responsive to excessive force applied to the table.

6. In the sofa of claim 5, said second link comprising an offset segment projecting away from said first link, said means comprising a recessed connector at said opposite end of said first link, and a detent on said offset segment of said second link, said detent snap-fitting into the recess when the movable section is in the operative position.

7. An upholstered sofa comprising:

a plurality of seating spaces;

a backrest behind said seating spaces having a section thereof movable between an upright inoperative position and an open operative position forwardly and away from the backrest and wherein said section provides a substantially horizontal armrest or table surface;

a pair of links pivotally connected at their opposite ends to said backrest and said movable section and operable to pivot said movable section into the operative position; and means on each of said links automatically engageable with each other when said movable section is pivoted to the operative position and cooperable with each other for retaining said movable section in the operative position.

* * * * *